US008056836B2

(12) United States Patent
Chen et al.

(10) Patent No.: US 8,056,836 B2
(45) Date of Patent: Nov. 15, 2011

(54) SWINGING SWITCHING STRUCTURE OF OUTLET DEVICE

(75) Inventors: Jianmin Chen, Xiamen (CN); Renzhong Li, Xiamen (CN)

(73) Assignee: Xiamen Solex High-Tech Co., Ltd., Xiamen (CN)

( * ) Notice: Subject to any disclaimer, the term of this patent is extended or adjusted under 35 U.S.C. 154(b) by 104 days.

(21) Appl. No.: 12/477,210

(22) Filed: Jun. 3, 2009

(65) Prior Publication Data

US 2010/0133364 A1 Jun. 3, 2010

(30) Foreign Application Priority Data

Dec. 1, 2008 (CN) ..... 2008 1 0072279

(51) Int. Cl.
*B05B 15/08* (2006.01)

(52) U.S. Cl. ..... 239/587.5; 239/394; 239/442; 239/443; 239/447; 239/579

(58) Field of Classification Search ..... 239/390, 239/392, 394, 436, 442–447, 576, 577, 579, 239/587.5, 587.4
See application file for complete search history.

(56) References Cited

U.S. PATENT DOCUMENTS

| | | | | |
|---|---|---|---|---|
| 3,623,670 | A * | 11/1971 | Wakeman et al. | 239/428.5 |
| 4,273,289 | A * | 6/1981 | Jette | 239/458 |
| 4,394,969 | A * | 7/1983 | Jette | 239/414 |
| 4,582,253 | A * | 4/1986 | Gerdes | 239/1 |
| 2005/0156062 | A1 * | 7/2005 | Thomas et al. | 239/548 |

* cited by examiner

*Primary Examiner* — Jason Boeckmann
(74) *Attorney, Agent, or Firm* — Rabin & Berdo, P.C.

(57) ABSTRACT

The present invention includes a swinging switching structure of outlet device fixed below a shower body, a water-dividing body sealed and fixed above an outlet device; said water-dividing body having at least two water-dividing bores so as to connect to the water cavities with different function of said outlet device having a movable switching device in the shower, and by the co-operation of shower and water-supply pipe-joint, when flapped, the shower will swing and inclined, then the movable switching device will control the water to spray out through different bores of water-diving body, thus achieving the switching of function. This water switching function of the shower is more efficient and flexible.

10 Claims, 4 Drawing Sheets

SWINGING SWITCHING STRUCTURE OF OUTLET DEVICE

FIELD OF THE INVENTION

The present invention relates to a shower device, more particularly, it relates to a swinging switching structure of outlet device.

BACKGROUND OF THE INVENTION

Shower is no longer has simple function of spraying only, multi-spraying functions such as bubble watering, massage watering or shower watering etc. can be achieved by the co-operation between the different inlet cavities of the cover and the different outlet bores. The selection of different spraying is to rotate the cover of the shower relative to the inlet bores of the water-dividing body to let the water flow into different inlet cavities of the cover, both hands must be used in such a structure-switching process, and the hand holding the cover will contact to the spraying water, moreover, the rotating moment is larger, thus the operation is not very convenient accordingly.

SUMMARY OF THE INVENTION

The object of the present invention is to provide a swinging switching structure of outlet device which can achieve different spraying functions by flapping different positions of the shower.

In order to achieve the above-described objects of the present invention, there is provided:

A swinging switching structure of outlet device comprising a shower body, a water-dividing body and an outlet device, said outlet device fixed below said shower body and said water-dividing body sealed and fixed upper said outlet device; said water-dividing body having at least two water-dividing bores so as to connect to the water cavities with different function of said outlet device; wherein: a movable switching device disposed upper said water-dividing body of said shower body is pass through the shower body and fixed with water-supply pipe-joint, when the shower body swang relative to said movable switching device, said movable switching device can block one of the water-dividing bores of the water-dividing body, while the other water-dividing bore is in open status.

The top surface of said water-dividing body formed three water-dividing bores which connected to the cavities with different functions of said outlet device; said movable switching device comprising two balls and a sleeve, the sphere diameter of said balls is larger than the diameter of said water-dividing bores of said water-dividing body; the upper portion of said sleeve pass through the inlet of said shower body and sealed and fixed in the water-supply pipe-joint, the lower portion of said sleeve formed an extended cover, said balls movably covered in this extended cover and contact with said water-dividing body.

The covering area of said extended cover is larger than the area where the water-dividing bores distributed.

An interstice is formed between said extended cover and said water-dividing body which allow said extended cover and water-dividing body to swing relative to each other.

The upper portion of said water-dividing body formed at least two protrusions oppositely, the inner wall of each protrusion having a water-dividing bore; said movable switching device comprising a sealing ring and a sleeve, said sealing ring movably set between said two protrusions and the internal diameter of said ring is larger than the external diameter of said sleeve; the upper portion of said sleeve pass through the inlet of shower body and sealed and fixed with water-supply pipe-joint, the lower portion of sleeve extended into the sealing ring.

The upper portion of said sleeve formed a necking so as to be sealed and fixed in the water-supply pipe-joint, the necking ringed by a sealing ring and formed a sealing co-operation with the inlet of said shower body.

The lower portion of said necking is a slant transition surface to the sleeve, the lower portion of pipe-joint is a funnel-shaped slant surface.

Said shower body is a bugle-shaped shell wherein a cylinder is formed in the upper portion, said movable switching device installed in said cylinder and said water-dividing body co-operated with the lower portion of said cylinder.

At least a reset mechanism co-operated with said movable switching device is transversely disposed in said shower body.

Said reset mechanism transversely set in the inner-wall of said cylinder comprising a sleeve, a reset spring and a protrusion, said reset spring disposed in the sleeve and support the protrusion to extend out said sleeve.

By the above-mentioned solution, the present invention having a movable switching device in the shower, and by the co-operation of shower and water-supply pipe-joint, when flapped, the shower will swing and inclined, then the movable switching device will control the water to spray out through different bores of water-diving body, thus achieve the switching of watering with different functions, therefore, the switching of the water of shower is more economy and flexible.

DETAILED DESCRIPTION OF THE PREFERRED EMBODIMENTS

Figure 1:
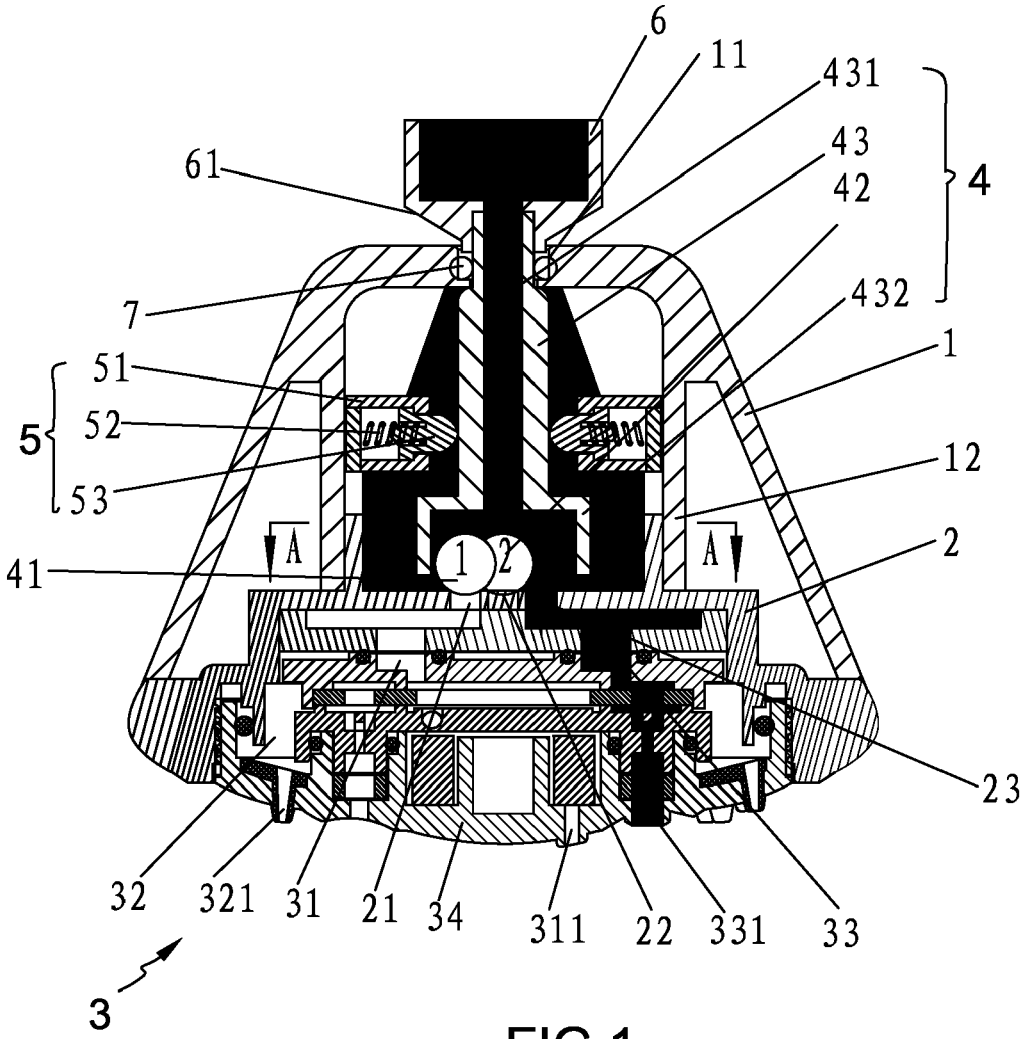
FIG. 1 is a sectional view of assembled structure of the present invention in embodiment 1 (bubble watering)

Please referring to FIG. 1 to FIG. 6, a swinging switching structure of outlet device comprising a shower body 1, a water-dividing body 2, an outlet device 3 and a movable switching device 4, said outlet device 3 fixed below said shower body 1 and said water-dividing body 2 sealed and fixed upper said outlet device 3; and further comprising a reset mechanism 5. The water-dividing body 2 having at least two water-dividing bores so as to connect to the water cavities with different function of said outlet device 3, when the shower body 1 swang relative to the movable switching device 4, the movable switching device 4 can block one water-dividing bore of the water-dividing body, while the other water-dividing bore is in open status.

Embodiment 1

Figure 2:
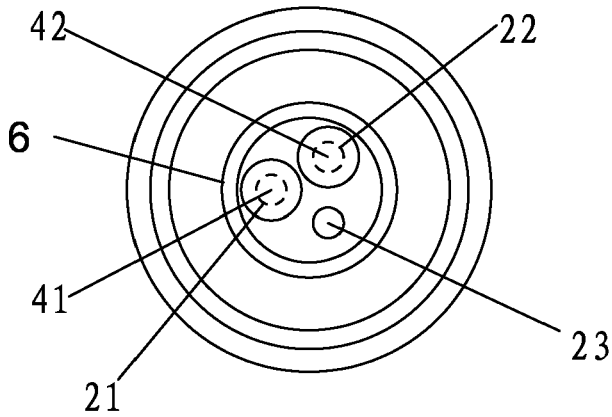
FIG. 2 is a sectional view taken along line A-A of FIG. 1.
Figure 3:
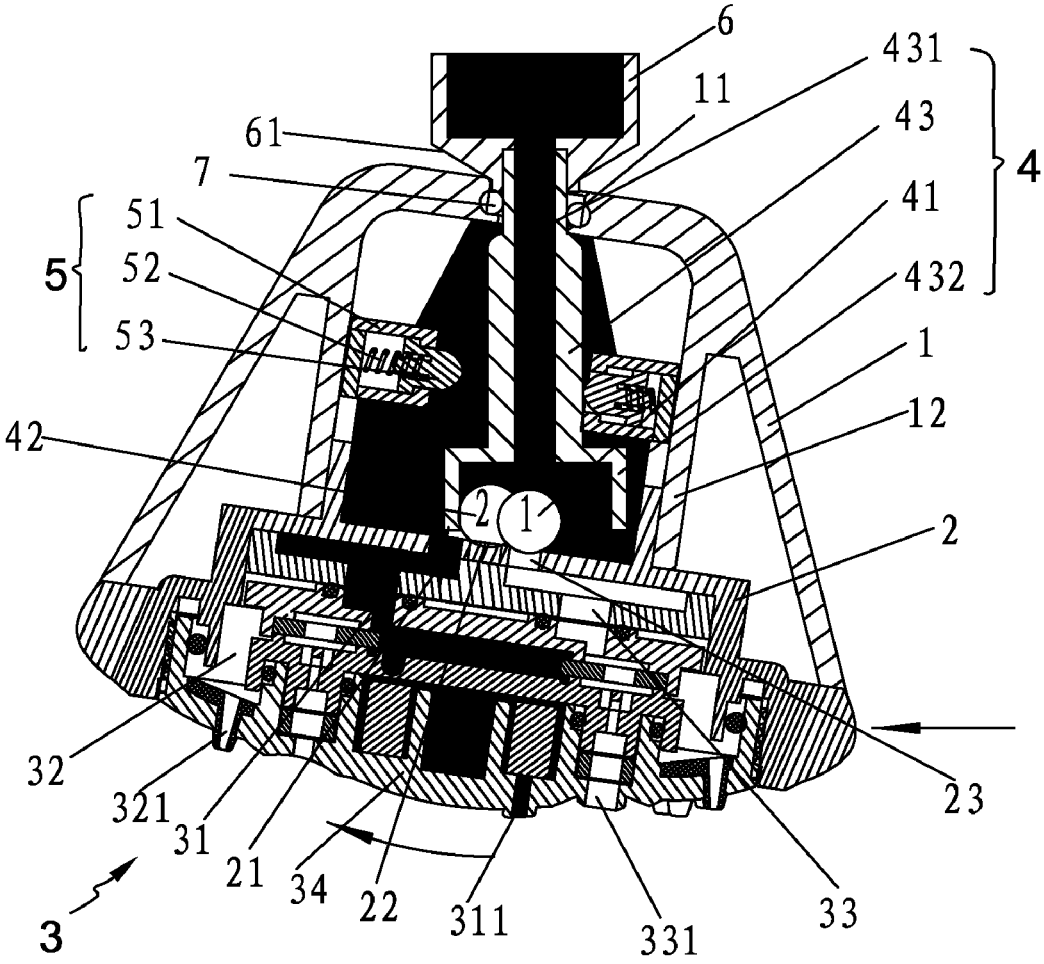
FIG. 3 is a sectional view of assembled structure of the present invention in embodiment 1 (massage watering)

Referring to FIGS. 1, 2 and 3, the swinging switching structure comprises a shower body 1, a water-dividing body 2, an outlet device 3 and a movable switching device 4, and further comprising a reset mechanism 5.

Herein the shower body 1 is a bugle-shaped shell wherein the outlet device 3 fixed on the lower portion, the water-dividing body 2 fixed on the top of the outlet device 3, the inlet 11 on upper portion of the shower body 1 movably connected with a water-supply pipe-joint 6, the movable switching device 4 set on the top of the water-dividing 2, and the upper portion of the movable switching device 4 fixed to the water-supply pipe-joint 6 via the inlet 11 of the shower body 1; a cylinder 12 is formed on the upper portion of shower body 1, the movable switching device 4 is in the cylinder 12, and water-dividing body 2 is co-operated with the lower portion of the cylinder 12.

The top surface of the water-dividing body 2 formed a first bore 21, a second bore 22 and a third bore 23 which connected to the different cavities with different functions of the outlet device 3 respectively, i.e. massage watering cavity 31, shower watering cavity 32 and bubble watering cavity 33.

Afore-mentioned three watering cavities of the outlet device 3 are corresponding to the outlet bores 311, 321 and 331 of the cover 34 respectively.

The movable switching device 4 comprises a first ball 41, a second ball 42 and a sleeve 43, the sphere diameter of the first ball 41 and second ball 42 is larger than the diameter of the first bore 21, the second bore 22 or the third bore 23 of the water-dividing body 2; the upper portion of sleeve 43 formed a necking 431 so as to be sealed and fixed in the water-supply pipe-joint 6 and to introduce and guide the water flow into the shower body 1, the lower portion of the necking 431 is a slant transition surface to the sleeve 43, and the lower portion of the sleeve 43 formed an extended cover 432, the covering area of the extended cover 432 is larger than the area where the first bore 21, second 22 and third bore 23 distributed; the first ball 41 and second ball 42 movably covered in the extended cover 432 and contact with the water-dividing body 2, an interstice formed between the extended cover 432 and the water-dividing body 2 which allow the extended cover 432 and the water-dividing body 2 to swing relative to each other.

At least two reset mechanism 5 on the upper of the extended cover 432 of the sleeve 43 transversely arranged in the inner wall of the cylinder 12, each reset mechanism 5 comprises a sleeve 51, a reset spring 52 and a protrusion 53, the reset spring 52 installed in the sleeve 51 and support the protrusion 53 to extend out the sleeve 51.

The lower portion of the water-supply pipe-joint 6 is a funnel-shaped slant surface 61, the upper portion of necking 431 of sleeve 43 fixed in the water-supply pipe-joint 6, and the lower portion of necking 431 sleeved in the sealing ring 7 to form a sealing co-operation with the inlet 11 of the shower body 1, it should be noted that the diameter of the sleeve 43 is larger than the diameter of the inlet 11 of the shower body 1, thus the shower can connect to the water-supply pipe-joint 6 via the sleeve 43, while the funnel-shaped slant surface 61 of the pipe-joint 6 and the slant surface of the lower portion of the sleeve 43 are all designed for providing a room for the shower body 1 swinging relative to the water-supply pipe-joint 6.

In operation, referring to FIG. 1 and FIG. 2, both the shower and the water-supply pipe-joint 6 are vertical, in this status the first ball 41 and the second ball 42 inserted in the first ball 21 and the second bore 22 respectively, and the third bore 23 is open, in the two figures the bubble watering cavity 33 of the outlet device 3 is open, therefore, the water can only pass through the bubble watering bore 331, thus the shower is spraying out water with bubbles.

Referring to FIG. 3, when the shower is flapped by hand from right side, because the sleeve 43 of movable switching device 4 is fixed with the water-supply pipe-joint 6, the sleeve 43 is not be moved, and the shower body 1 with outlet device 3 and water-dividing body 2 will swing clockwise relative to the co-operation position of the upper portion of the sleeve 43 and the shower body 1, When reach a certain angle, because the water-dividing body 2 is inclined, the first ball 41 will contact the left side of the extended cover 432 of the sleeve 43, when the swinging angle is added, the ball 41 will be pushed from the first bore 21 to the third bore 23, thus the third bore 23 is closed and the first bore is opened, in FIG. 3 the massage watering cavity 31 of the outlet device 3 is open, the bubble watering of the shower is switched to massage watering; meanwhile, the reset mechanism 5 in the right side of the shower body 1 is in energy storing status, but the reset force is lager than the friction of the sealing ring 7 in the inlet 11 of the shower body 1 forced on the shower, therefore, the shower can be reset to the vertical position.

When the shower is flapped by another side, the shower will overcome the friction and swing to another side by the reset force of the rest mechanism 5; in a similar way, when the swing angle added, the first ball 41 or the second ball 42 will be pushed into the first bore 21, the second ball is then opened, the shower watering cavity 32 of the outlet device 3 is in open status, then the massage watering will be switched to showering water.

In the same way, when be flapped in different position, the shower can be switched to different functions.

Three watering functions are described in this embodiment, the amount of bores in the water-dividing body 2 is set according to the amount of the cavities of the outlet device 3, accordingly, the amount of the balls in the movable switching device 4 is a number one less than the amount of the bores.

Embodiment 2

Figure 4:
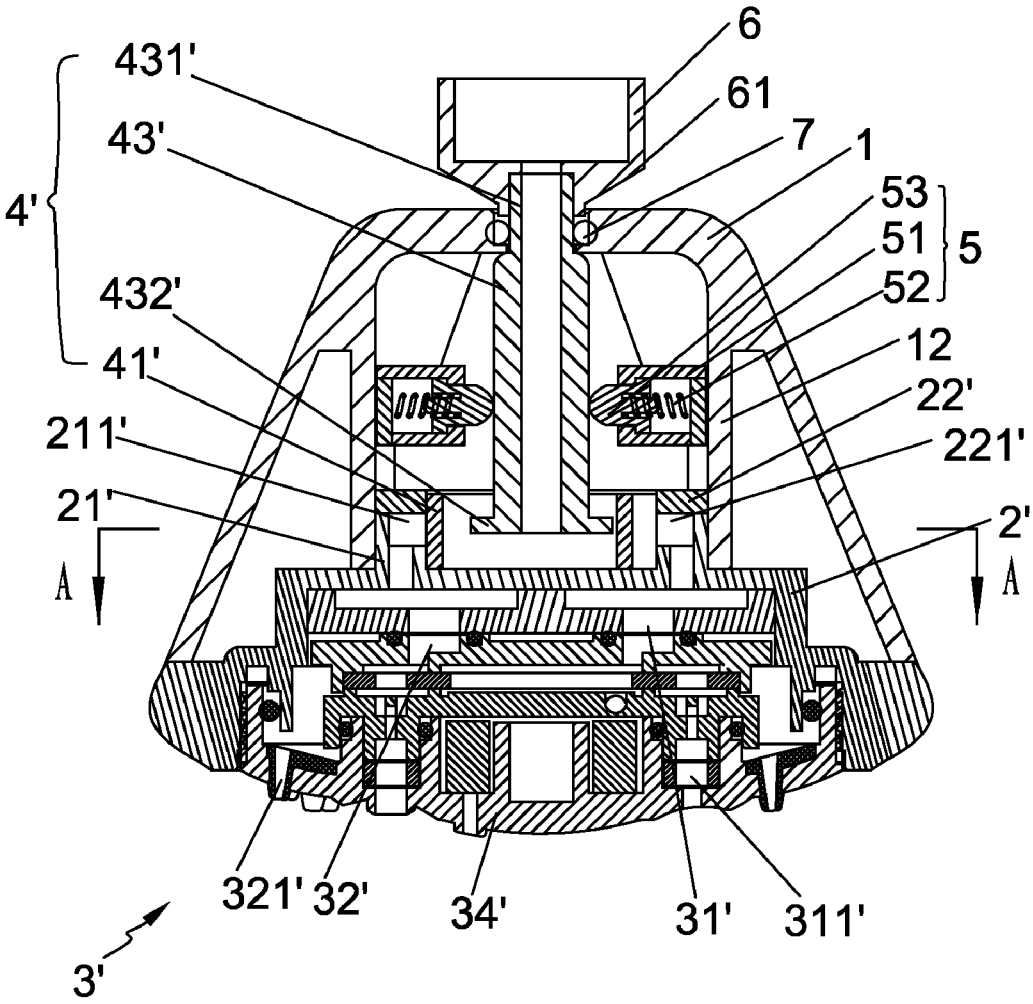
FIG. 4 is a sectional view of assembled structure of the present invention in embodiment 2 (massage watering)
Figure 5:
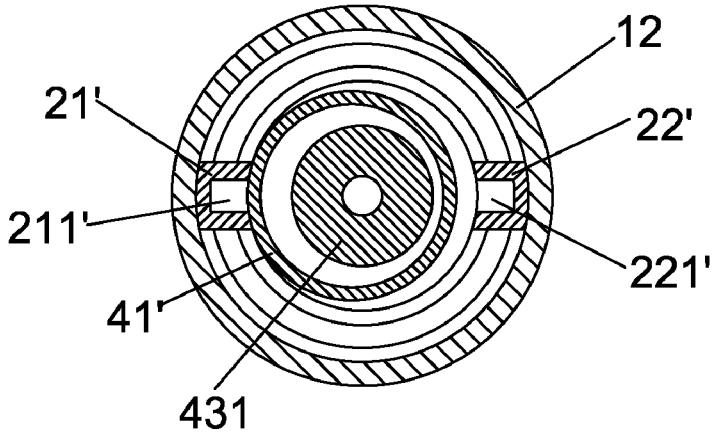
FIG. 5 is a sectional view taken along line A-A of FIG. 4.
Figure 6:
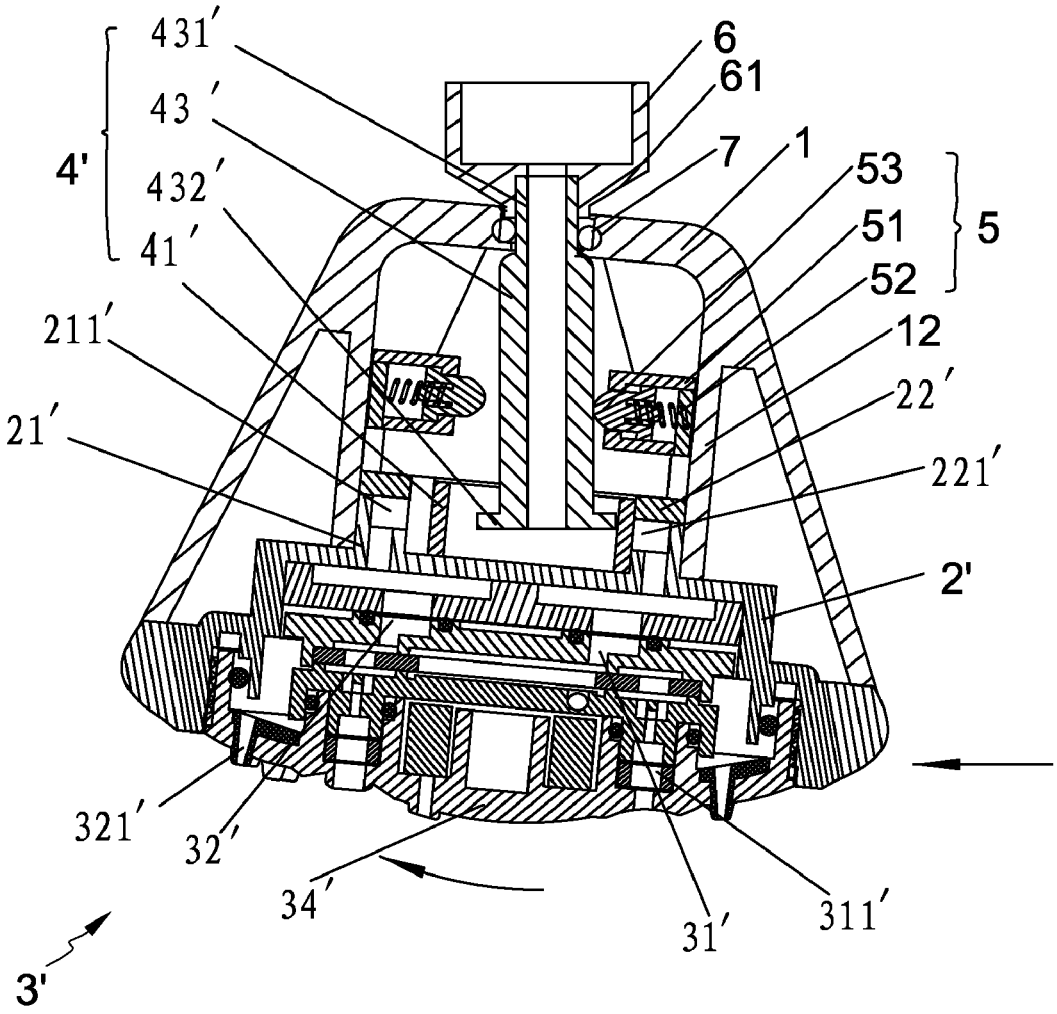
FIG. 6 is a sectional view of assembled structure of the present invention in embodiment 2 (bubble watering).

Referring to FIGS. 4, 5 and 6, a swinging switching structure of outlet device in another embodiment comprising a shower body 1, a water-dividing body 2' an outlet device 3' and a movable switching device 4' and further comprising a reset mechanism 5.

Herein the shower body 1 is a bugle-shaped shell wherein the outlet device 3 fixed on the lower portion, the water-dividing body 2 fixed on the top of the outlet device 3, the inlet 11 on the shower body 1 movably connected with a water-supply pipe-joint 6, the movable switching device 4 set on the upper of the water-dividing 2, and the upper portion of the movable switching device 4 fixed to the water-supply pipe-joint 6 via the inlet 11 of the shower body 1; a cylinder 12 is formed on the upper portion of shower body 1, the movable switching device 4 is in the cylinder 12, and water dividing body 2 is co-operated with the lower portion of the cylinder 12.

The upper portion of the water-dividing body 2 formed two protrusion 21', 22' oppositely, bores 211', 221' disposed in the inner wall of the protrusion 21', 22' respectively are connected to the bubble watering cavity 32', massage watering cavity 31' respectively. Certainly, the upper portion of the water-dividing 2' can form a plurality of protrusions to form a plurality of bores so as to connect to a plurality of cavities with different functions, in this embodiment only two watering functions are described here.

The massage watering cavity 31', bubble watering cavity 32' in the outlet device 3' is corresponding to the bores 311', 321' in the cover 34'.

The movable switching device 4' comprises a sealing ring 41' and a sleeve 43', the external diameter of the sealing ring 41' is smaller than the distance between the two protrusion 21' and 22', while the internal diameter is larger than the external diameter of the sleeve 43'; the upper portion of the sleeve 43' formed a necking 431' so as to be sealed an fixed in the water-supply pipe-joint 6 to import the water into the shower body 1, the lower portion of the necking 431' is a slant transition surface to the sleeve 43', while the lower portion of the sleeve 43' formed an annular flange 432', the external diameter of the annular flange 432' is smaller than the internal diameter of the sealing ring 41', the lower portion of the sleeve 43' is extended into the sealing ring 41', and the sealing ring 41' is sandwiched movably between the protrusion 21' and 22'.

Upper the protrusions 21', 22' of the water-dividing body 2', at least two reset mechanism 5 transversely arranged in the inner wall of the cylinder 12, each reset mechanism 5 comprises a sleeve 51, a reset spring 52 and a protrusion 53, the reset spring 52 installed in the sleeve 51 and support the protrusion 53 to extend out the sleeve 51.

The lower portion of the water-supply pipe-joint 6 is a funnel-shaped slant surface 61, the upper portion of necking 431' of sleeve 43' fixed in the water-supply pipe-joint 6, and the lower portion of necking 431' sleeved in the sealing ring 7 to co-operate with the inlet 11 of the shower body 1, it should be noted that the diameter of the sleeve 43' is larger than the diameter of the inlet 11 of the shower body 1, thus the shower can connect to the water-supply pipe-joint 6 via the sleeve 43', while the funnel-shaped slant surface 61 of the pipe-joint 6 and the slant surface of the lower portion of the necking 431' of the sleeve 43' are all designed for providing a room for the shower body 1 swinging relative to the water-supply pipe-joint 6.

In operation, referring to FIG. 4 and FIG. 5, the sealing ring 41' blocked the bore 211' of the left protrusion 21' of the water-dividing body 2', in the figures shows that the massage watering cavity 31' of the outlet device 3' is in open status, then the water can only spray from the massage watering bore 311', therefore, the show sprayed out massage water in this status.

Referring to FIG. 6, when the shower is flapped by hand from right side, because the sleeve 43' of movable switching device 4' is fixed with the water-supply pipe-joint 6, the sleeve 43' is not be moved, while the shower body 1 with outlet device 3 and water-dividing body 2 will swing clockwise relative to the co-operation position of the upper portion of the sleeve 43' and the shower body 1, When reach a certain angle, the sealing ring 41' will be pushed to the bore 221' of the right protrusion 22' of the water-dividing body 2' by the annular flange 432' in the lower portion of the sleeve 43', then the bore 221' is blocked, the FIG. 6 shows that the bubble watering cavity 32' of the outlet device 3' is open, the shower spraying massage water is switched to water with bubble; meanwhile, the reset mechanism 5 in the right side of the shower body 1 is in energy storing status, but the reset force is lager than the friction of the sealing ring 7 in the inlet 11 of the shower body 1 forced on the shower, therefore, the shower can be reset to the vertical position.

When the shower is flapped by another side, the shower will overcome the friction and swing to another side; the sleeve 43' will push the sealing ring 41' to open the bore 221', meanwhile, the other bore 211' is open, thus both the two bores 211', 221' are opened, therefore, the shower sprayed both massage water and water with bubble.

In the same way, when flapped in different position, the shower can be switched to different functions.

In summary, the present invention having a movable switching device in the shower, and by the co-operation of shower and water-supply pipe-joint, when the shower is flapped, it will swing and be inclined, then the movable switching device will control the water to spray out through different bores of water-diving body, thus achieve the switching of different function of the water, therefore, the switching of the water of shower is more economy and flexible.

What is claimed is:

1. A swinging switching structure of outlet device, comprising:

a shower body;

an outlet device disposed below said shower body, the outlet device having a plurality of water cavities each corresponding to a different function;

a water-dividing body disposed between the shower body and the outlet device and sealing said outlet device, said water-dividing body having a plurality of water-dividing bores each connected to one of the plurality of water cavities of said outlet device;

a switching device disposed in the shower body, the switching device being above said water-dividing body and being fixed with a water-supply pipe-joint, such that, when the shower body swings relatively to said switching device, said switching device blocks all but one of the water-dividing bores of the water-dividing body, while the one water-dividing bore is in open status; and a reset mechanism transversely disposed in said shower body and operatively coupled with said switching device, such that, when the shower body swings relatively to the switching device, the reset mechanism stores energy to reset the shower body to a vertical position, wherein said shower body is a bugle-shaped shell with a cylinder formed in an upper portion thereof, said switching device being installed in said cylinder, and said water-dividing body co-operating with a lower portion of said cylinder, and said reset mechanism is transversely disposed in an inner-wall of said cylinder, and includes a sleeve, a reset spring and a protrusion, said reset spring being disposed in the sleeve and supporting the protrusion to extend out said sleeve.

2. The swinging switching structure of outlet device according to claim 1, wherein the plurality of water-dividing bores are three water-dividing bores formed on a top surface of said water-dividing body; and said switching device comprising two balls and a sleeve, the sphere diameter of each ball being larger than the diameter of each of said three water-dividing bores of said water-dividing body, an upper portion of said sleeve passing through an inlet of said shower body, being connected to the water-supply pipe-joint, and sealing the water-supply pipe-joint, a lower portion of said sleeve forming an extended cover, said balls being movably covered in this extended cover and contacting with said water-dividing body.

3. The swinging switching structure of outlet device according to claim 2, wherein said extended cover covers an area larger than an area where the three water-dividing bores are distributed.

4. The swinging switching structure of outlet device according to claim 2, wherein an interstice is formed between said extended cover and said water-dividing body, the interstice allowing said extended cover and said water-dividing body to swing relatively to each other.

5. The swinging switching structure of outlet device according to claim 1, wherein the upper portion of said water-dividing body formed at least two protrusions oppositely, the inner wall of each protrusion having a water-dividing bore; said movable switching device comprising a sealing ring and a sleeve, said sealing ring movably set between said two protrusions and the internal diameter of said ring is larger than the external diameter of said sleeve; the upper portion of said sleeve pass through the inlet of shower body and sealed and fixed with water-supply pipe-joint, the lower portion of sleeve extended into the sealing ring.

6. The swinging switching structure of outlet device according to claim 3, wherein an interstice is formed between said extended cover and said water-dividing body, the interstice allowing said extended cover and said water-dividing body to swing relatively to each other.

7. The swinging switching structure of outlet device according to claim 5, wherein the upper portion of said sleeve formed a necking so as to be sealed and fixed in the water-supply pipe-joint, the necking ringed by a sealing ring and formed a sealing co-operation with the inlet of said shower body.

8. The swinging switching structure of outlet device according to claim 7, wherein the lower portion of said necking is a slant transition surface to the sleeve, the lower portion of pipe-joint is a funnel-shaped slant surface.

9. A swinging switching structure of outlet device comprising:

a shower body;

an outlet device disposed below said shower body, the outlet device having a plurality of water cavities each corresponding to a different function;

a water-dividing body disposed between the shower body and the outlet device and sealing said outlet device, said water-dividing body having a plurality of water-dividing bores each connected to one of the plurality of water cavities of said outlet device;

a switching device disposed in the shower body, the switching device being above said water-dividing body and being fixed with a water-supply pipe-joint, such that, when the shower body swings relatively to said switching device, said switching device blocks all but one of the water-dividing bores of the water-dividing body, while the one water-dividing bore is in open status; and a reset mechanism transversely disposed in said shower body and operatively coupled with said switching device, such that, when the shower body swings relatively to the switching device, the reset mechanism stores energy to reset the shower body to a vertical position, wherein the plurality of water-dividing bores are three water-dividing bores formed on a top surface of said water-dividing body;

said switching device comprising two balls and a sleeve, the sphere diameter of each ball being larger than the diameter of each of said three water-dividing bores of said water-dividing body, an upper portion of said sleeve passing through an inlet of said shower body, being connected to the water-supply pipe-joint, and sealing the water-supply pipe-joint, a lower portion of said sleeve forming an extended cover, said balls being movably covered in this extended cover and contacting with said water-dividing body; and the upper portion of said sleeve includes a necking, so as to be connected to and seal the water-supply pipe-joint, and to seal the inlet of said shower body through a sealing ring disposed between the inlet and the necking.

10. The swinging switching structure of outlet device according to claim 9, wherein a lower portion of said necking includes a slant transition surface to the sleeve; and a lower portion of the water-supply pipe-joint includes a funnel-shaped slant surface.

* * * * *